United States Patent [19]

Robolin

[11] Patent Number: 4,646,655

[45] Date of Patent: Mar. 3, 1987

[54] DATA PROCESSING WORK STATION

[76] Inventor: Claude Robolin, P.O. Box 592, Lavonia, Ga. 30553

[21] Appl. No.: 619,783

[22] Filed: Jun. 11, 1984

[51] Int. Cl.[4] ..... A47B 9/04

[52] U.S. Cl. ..... 108/92; 108/64; 108/101; 108/108; 108/94

[58] Field of Search ..... 108/92, 103, 94, 96, 108/69, 101, 79; 248/188.1

[56] References Cited

U.S. PATENT DOCUMENTS

| | | | |
|---|---|---|---|
| 2,016,850 | 10/1935 | Bittermann | 108/94 |
| 2,456,037 | 12/1948 | Woods | 108/94 X |
| 2,499,062 | 2/1950 | Greenberg | 108/94 |
| 2,758,632 | 8/1956 | Koller et al. | 248/188.1 |
| 3,170,418 | 2/1965 | Gruenstein | 108/101 |
| 3,521,579 | 7/1970 | Stafford | 108/64 |
| 3,964,401 | 6/1976 | Gutmann, Jr. et al. | 108/64 |
| 4,022,136 | 5/1977 | Schott | 108/108 |
| 4,312,086 | 1/1982 | Bianco | 248/188.1 X |
| 4,428,631 | 1/1984 | Cope et al. | 108/92 X |

FOREIGN PATENT DOCUMENTS

| | | | |
|---|---|---|---|
| 8301183 | 4/1983 | Fed. Rep. of Germany | 108/64 |
| 45286 | 4/1935 | France | 248/188.1 |
| 59675 | 2/1954 | France | 108/96 |

*Primary Examiner*—Peter A. Aschenbrenner
*Attorney, Agent, or Firm*—Thomas & Kennedy

[57] ABSTRACT

A data processing work station has a tubular framework that supports a keyboard support shelf in front of and below a video display support shelf and a pair of side shelves. The framework may be reconfigured into a compacted configuration for storage and shipment.

1 Claim, 5 Drawing Figures

DATA PROCESSING WORK STATION

TECHNICAL FIELD

This invention relates to work station furniture of the type used to support modular data processing equipment.

BACKGROUND OF THE INVENTION

Data processing systems today are typically comprised of a keyboard, a computer, a video display screen and a printer. To provide set-up and system flexibility these units are often placed in separate housings as functionally independent modules that are coupled together only by means of flexible, electrical wiring. Though the use of modules does provide benefits it does present a problem were the modules are located together upon a common support surface such as a desk or table top. For example, there is often insufficient desk top depth to accommodate both a keyboard and a display screen where they are set one behind the other. As a result in such situations the display screen must be located to one side of the keyboard. This however requires that the operator maintain his head or eyes at a cocked angle from his torso to view the display screen while using the keyboard as otherwise the operator would have to face the screen itself and operate the keyboard in a skewed body position. Another problem presented by such positioning of these modules on a common support surface is that normal typing height of keyboards and the normal viewing height of display screens are not the same. Still another problem is the frequent lack of total space availability for those data processing systems that include several modules such as those that have individual computer and printer modules.

Attempts have heretofore been made to solve these problems by the provision of built-in, stand alone consoles. Representative of these are those disclosed in U.S. Pat. Nos. 3,778,125 and 4,316,082. These consoles have been of highly specialized designs particularly adapted for use with keyboards, printers and display units of a specific shape and size. As a result they have been lacking in versatility, i.e., for use with data processing system modules of other shapes, sizes and numbers.

Recently, in an attempt to provide enhanced versatility and adaptability, data processing work stations have been devised of a portable stand type. Exemplary of these are those shown in U.S. Pat. Nos. 4,313,112 and Des. 266,672. These however are, by and large, limited to that portion of the market where purchasers already have a stand, table or the like available upon which the portable stand itself may be set. Their aesthetics are also lacking once the modules are placed thereon and interconnected with very exposed wiring. They are also often limited to those systems possessing only two modules.

It thus is seen that data processing work stations have been devised of both stand alone and portable constructions. The stand alone station furniture has been lacking in versatility due to the fact that they have been designed specifically for use with modules of selected shapes and sizes. Their bulk also makes them difficult to ship and to stow. The portable work stations have been lacking in that they have required the use of auxiliary stands, tables or the like and can only accomodate a very limited number of modules. It thus is seen that a need remains for a data processing work station which has versatility, which has simplicity of design and shape, which may be stored in a compacted configuration for shipment or storage, which does not require any auxiliary furniture for its own support and which may accomodate a number of modules. It is to the provision of such a data processing work station to which the present invention is primarily directed.

SUMMARY OF THE INVENTION

In one form of the invention a data processing work station comprises a tubular front frame upon which a keyboard support shelf is mounted and a tubular rear frame upon which a display support shelf is mounted at a height above said keyboard support shelf. The front frame has a pair of upright tubular front legs while the rear frame has a pair of upright tubular rear legs secured back to back to the front legs. The front legs merge with a pair of tubular front feet that extend horizontally beneath the keyboard support shelf while the pair of rear legs merge with a pair of tubular rear feet that extend horizontally beneath the display support shelf.

In another form of the invention a data process work station comprises a tubular front frame upon which a keyboard support shelf is supported, a tubular rear frame upon which a display support shelf is supported behind and above the keyboard support shelf, and a pair of tubular wing frames upon which a pair of side shelves is supported for pivotable movement between a position beneath the keyboard support shelf and display support shelf and a position partially behind the keyboard support shelf and partially beneath the display support shelf.

In yet another form of the invention a data processing work station comprises a tubular framework upon which a plurality of shelves are supported. The tubular framework comprises a front frame, a rear frame mounted to the front frame, and two wing frames mounted to opposite sides of the rear frame. The front frame has two upright tubular front legs and a horizontal, U-shaped tubular front crossbar having downturned ends telescopically mounted to the upper ends of the front legs. The rear frame has two upright tubular rear legs mounted to the front legs and a horizontal, U-shaped tubular rear crossbar having downturned ends telescopically mounted to the upper ends of the rear legs with the crossbar being at a height above the height of the front crossbar. Each of the wing frames has an upright tubular collar coupled with one of the rear legs through which a tubular wing leg extends. The plurality of shelves includes a keyboard shelf supported atop the front crossbar, a display support shelf supported atop the rear crossbar, and two side shelves supported atop the two wing frames.

DETAILED DESCRIPTION

Figure 1:
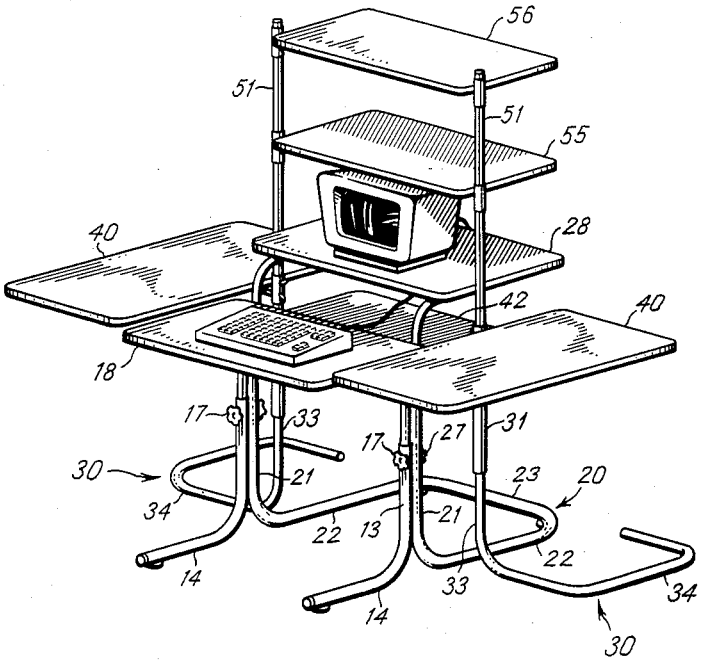
FIG. 1 is a perspective view of a data processing work station embodying principles of the invention shown assembled and with a keyboard and a video display unit mounted thereon.

With reference next to the drawings, there is shown a data processing work station which has a tubular framework upon which several shelves are mounted. The framework includes a front frame 12 comprised of two tubular, upright, front legs 13 which merge with two horizontal feet 14 that are oriented parallel with one another. The front frame also includes a tubular, horizontal, U-shaped crossbar 15 having downturned ends 16 which are telescopically received within the upper ends of the front legs 13 and held thereto at adjustable heights by means of set screws indicated generally at 17. A keyboard support shelf 18 is mounted atop the horizontal crossbar 15 by unshown screw means which are passed upwardly through aligned holes in the tubular crossbar. The other shelves of the work station are similarly secured to their support elements of the tubular framework.

The framework is further seen to include a tubular rear frame indicated generally at 20 which has two tubular, upright, rear legs 21 which merge with two, mutually parallel, horizontal feet 22 that merge with a crossbar 23. The rear frame 20 also has a tubular, horizontal, U-shaped crossbar 25 having downturned ends 26 telescopically received within the upper ends of the upright legs 21 and held thereto at adjustable heights by set screws 27. A display support shelf 28 is mounted upon the crossbar 25 behind and at a height above the height of the keyboard support shelf.

Figure 2:
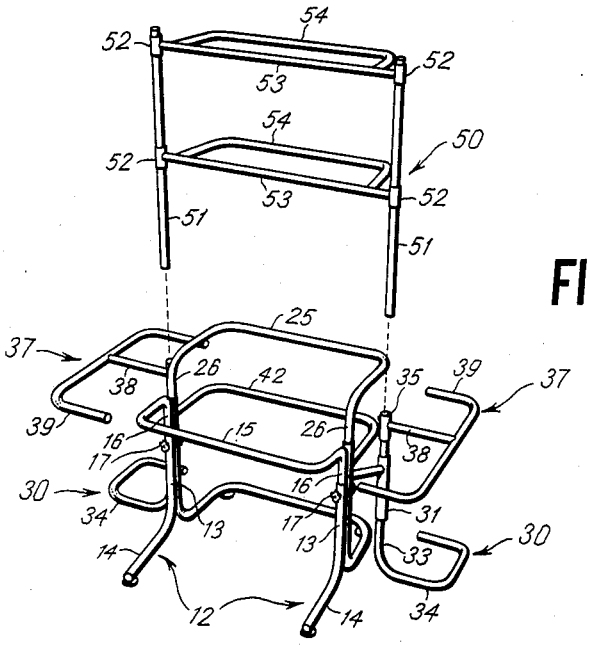
FIG. 2 is a perspective view, partially exploded, of the data processing work station illustrated in FIG. 1 without its shelves.

With continued reference to the drawings the framework is also seen to include two wing frames indicated generally at 30 each of which includes an upright, tubular collar 31 that is coupled with an upper end portion of a rear leg 21 by a tubular beam 32. A tubular leg 33 extends completely through the collar 31 with its lower portion merging with a tubular, horizontal U-shaped foot 34. Another collar 35 is mounted to an upper end portion of each leg 33 and held in its rotary position by a wing nut 36. A wing support arm of a generally E-shaped configuration, indicated generally at 37, is mounted to the collar 35. Specifically, its middle arm 38 extends from collar 35 while its other two arms 39 straddle the middle leg 38. As shown by a comparison between FIGS. 2 and 5, the wing support arms 37 may be moved between the position illustrated in FIG. 2, supporting a side shelf 40 beside the keyboard support shelf 18 and the display support shelf 28, and the position illustrated in FIG. 5 with a portion of each side shelf located behind the keyboard support shelf 18 and beneath the display support shelf 28. A U-shaped, rear support frame 42 is also seen to be mounted to upper ends of the front legs 13.

Finally, the framework is seen to include an auxiliary frame indicated generally at 50, which has two parallel, upright tubular legs 51 adapted to be telescopically inserted into the upper ends of the wing frame collars 35 upon the upper ends of legs 33. This auxiliary frame has four collars 52 secured to the upright legs 51 between which extend two crossbars 53. Two U-shaped arms 54 extend horizontally and rearwardly from the crossbars. The crossbars and the U-shaped arms collectively support a pair of auxiliary shelves 55 and 56 one above the other and both above the display support shelf 28.

Figure 4:
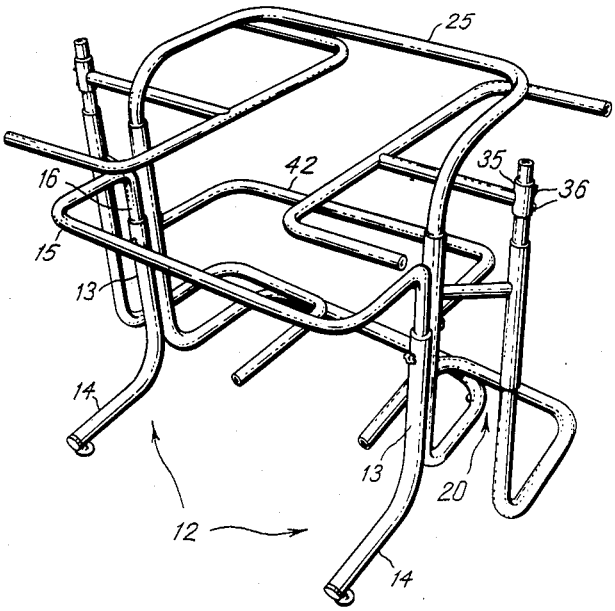
FIG. 4 is a perspective view of the data processing work station illustrated in FIG. 3 shown in a compacted configuration.

In use a keyboard may be set upon the keyboard support shelf 18 as shown in FIG. 1 and electrically coupled with a video display 61 set upon the display shelf 28 by a flexible electric cord that extends from the rear of the keyboard beneath the display shelf 28 to the rear of the display. Where the data processing system includes other modules, such as a computer module and a printer, they may be set upon the rear shelf 42 behind the keyboard and beneath the video display, depending on their sizes. Alternatively, one or more of such additional modules may be placed upon the side shelves and/or on the auxiliary shelves. In any case it is seen that the electrical wiring interconnecting the various modules is, by and large, out of sight running generally beneath the display shelf 28. The side shelves 40 as well as the auxiliary shelves 55 and 56 may, of course, be used to support other materials and equipment that are commonly found at data processing work stations. When the station is not in use it may be easily reconfigured into a compacted configuration as for storage or shipment. This is done by removing the shelves and the auxiliary frame and then rotating wing frame elements inwardly as shown in FIG. 4.

It thus is seen that a data processing work station is provided of a free standing type upon which various data processing modules may be supported in selected positions relatively to each other. When a keyboard and display are positioned upon such the keyboard is preferably in front of and at an elevation slightly below that of the video display screen for ease of operation and viewing. Where the auxiliary frame is used the video display screen is located within the shadow of the auxiliary panel 55 which may facilitate viewing by decreasing ambient lighting that impinges upon the screen. Other modules may be easily connected and positioned as desired upon the other shelves. The elevation of the shelves may also be easily adjusted by manipulation of the set screws and wing bolts.

Figure 3:
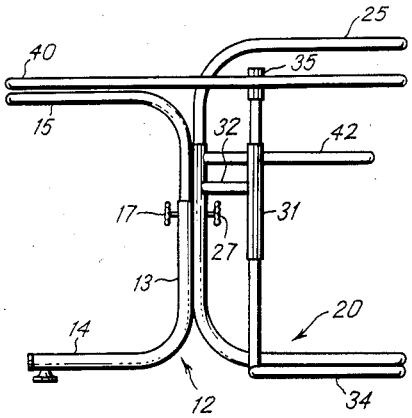
FIG. 3 is a side elevational view of the data processing work station illustrated in FIG. 1 with an upper, auxiliary portion thereof removed.
Figure 5:
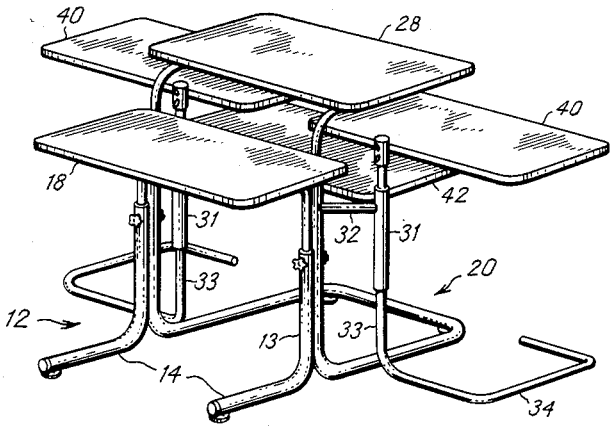
FIG. 5 is a perspective view of the data processing work station illustrated in FIG. 3 with its wing shelves shown oriented in an alternative position.

Further versatility of the work station is demonstrated by the fact that the wing shelves may be rotated some 90° to the position illustrated in FIG. 5 as space availability and aesthetic considerations dictate. Again, the elevation of the side shelves may be readily adjusted as, for example, such as necessary to elevate them over a module set upon the rear shelf 28. Again, the work station may be easily oriented into the compacted configuration shown in FIG. 4 for storage or shipment. That the framework shown here is of tubular configuration provides aesthetic value to the station as well as rendering its manufacture inexpensive and its assembly relatively easy. As shown by reference to FIG. 3 it is also seen that the various elements that are in contact with the supporting floor are all under the various shelves. This provides efficient conservation of space as well as sound support for the various shelves once loaded.

It should be understood that the just described embodiment merely illustrated principles of the invention in one preferred form. Many modifications, additions and deletions may, of course, be made thereto without departure from the spirit and scope of the invention as set forth in the following claims.

I claim:

1. A data processing work station comprising a tubular front frame upon which a keyboard support shelf is mounted and a tubular rear frame upon which a display support shelf is mounted at a height above said keyboard support shelf, wherein said front frame has a pair of upright tubular front legs and said rear frame has a pair of upright tubular rear legs secured back to back to said front legs, and wherein said pair of front legs merges with a pair of tubular front feet that extend horizontally beneath said keyboard support shelf and said pair of rear legs merges with a pair of tubular rear feet that extend horizontally beneath said display support shelf, and further comprising a pair of tubular wing frames upon which a pair of side shelves is supported and tubular coupling means coupling said wing frames to said rear legs and wherein each of said wing frames includes an upright tubular member upon which a tubular support arm is rotatably mounted for movement of one of said side shelves between an operative position aside said display and keyboard shelves and a stowed position substantially beneath said display shelf and wherein each of said wing frame upright tubular members includes an open upper end adapted to receive tubular legs of auxiliary frame means for supporting an auxiliary shelf above the display shelf with the auxiliary frame tubular legs straddling the display shelf.

* * * * *